United States Patent [19]
Swette
[11] 4,317,565
[45] Mar. 2, 1982

[54] TRANSCRIPTION-COPY FEEDER

[76] Inventor: Larry L. Swette, 6 Stearns St., Newton Centre, Mass. 02159

[21] Appl. No.: 116,756

[22] Filed: Jan. 30, 1980

[51] Int. Cl.³ ..... B41J 11/36

[52] U.S. Cl. ..... 271/274; 400/718; 40/343

[58] Field of Search ..... 271/274, 273; 400/718, 400/718.1, 718.2; 40/343

[56] References Cited

U.S. PATENT DOCUMENTS 999,181 7/1911 Peetz ..... 400/718.2
2,949,886 8/1960 Tibbling ..... 400/718 X
3,176,660 4/1965 Selser ..... 400/718.1

*Primary Examiner*—Richard A. Schacher

[57] ABSTRACT

A foot-operable electromechanical paper feeding device designed to display handwritten or printed information in continual serial line order for transcription to typewritten copy or computer terminal entry. The transcription copy feeder displays single lines of any letter height in a fixed horizontal space directly behind the typewriter or keyboard, and may be operated to feed paper in forward or reverse at variable speed.

4 Claims, 2 Drawing Figures

TRANSCRIPTION-COPY FEEDER

BACKGROUND OF THE INVENTION

This invention relates to an electromechanical device which can be used to facilitate the visual/manual process of transcribing handwritten, typed or printed information to a typewritten copy using a typewriter or to a computer input terminal using an alpha-numeric keyboard.

Two types of devices are presently available for these types of application. The simpler of these devices consists of an approximate 9 inch by 12 inch sheet metal frame arranged so as to stand at about a 120 degree angle from horizontal. It is typically placed to the right or left of the typewriter or keyboard and will accomodate an 8½ inch by 11 inch sheet of transcription copy. Generally a horizontal manual index, such as a magnetic bar, is provided to underscore the line being transcribed. A more complex variation, based on the same moving index principle, is intended to be placed directly behind the typewriter; the line index is operated by a remote mechanical linkage to a foot pedal or manual key on or near the keyboard, the line index is moved by a rack and pinion or ratchet type linkage one line at a time according to a pre-set spacing. Compared to the simpler copy holder, the latter device has the following advantages: (1) it allows the operator is look forward, rather than right of left, thus reducing fatigue, (2) it places the transcription copy in somewhat closer proximity to the transcribed copy for easier visual checking, and (3) it allows remote indexing so that the operator's hands need not be raised from the keyboard to manually index each line of the copy, thus increasing transcription speed.

DESCRIPTION OF THE INVENTION

The present invention is a significant improvement upon such transcription copy holders as described above. It is intended to be placed directly behind the typewriter or keyboard; it may be free standing on the floor or on the same table as the keyboard, or it may be supported by the weight of the typewriter on an integral L-shaped bracket. Line indexing is accomplished by feeding of the transcription copy between two rollers, one driven by an electric motor and one free running, vertically upward between a series of guides to display the horizontal lines of transcription data at a convenient level above the keyboard. The electric motor powering the feed roller is actuated by depressing a foot switch. The motor is ideally of variable speed in the range of 10 to 60 revolutions/minute with 20–200 inch-ounces of torque, and reversible with dynamic braking. The motor, feed roller and paper guides are mounted horizontally on two vertical upright support members on opposite ends. The tension roller is mounted on a separate support frame which is fixed to the main vertical support members by pivots below the feed roller. This free-running tension roller is brought into opposition with the feed roller by spring attachment between the tension roller frame and the main vertical support members above the pivot point. The rollers may be separated manually to insert the transcription copy sheet. The feed roller is provided with rubber friction rings or covered with a non-slip surface to feed the paper evenly and uniformly.

The paper guides are pins or bars positioned to provide indexing and to deflect the paper toward the back of the device. The lower-most bar, positioned slightly above the tension roller and just forward of the paper feed (junction of the rollers), serves as the stationary line index. The next higher bar, positioned about a half inch higher and just behind the paper feed, keeps the paper vertical to display the lines of copy. The topmost bar, positioned another half inch higher and slightly further to the back, serves to deflect the paper away from the operator. In operation then, depression of the foot switch actuates the electric motor feeding the sheet of transcription copy upward (or downward if the motor is in the reverse mode) between the feedroller and the tension roller, behind the index bar, in front of the vertical keeper bar, and under the deflection bar until the line of transcription copy is displayed above the index bar and the foot switch is released.

The present invention has all of the advantages of the previously described copy holders and incorporates the following improvements: (1) line indexing is accomplished by motion of the paper behind a guide/index rather than by the vertical motion of an index bar down the face of the copy; this has the effect of keeping the line of copy being transcribed in a fixed position and in close proximity to the line being entered from the keyboard for greater accuracy and less operator fatigue; (2) the variable feed increment available, in forward or reverse at variable speed and by remote foot pedal operation, permits accomodation of various line spacings on the transcription copy, including the changing and uneven line spacings of typical hand written material, at increased transcription speeds.

Figure 1:
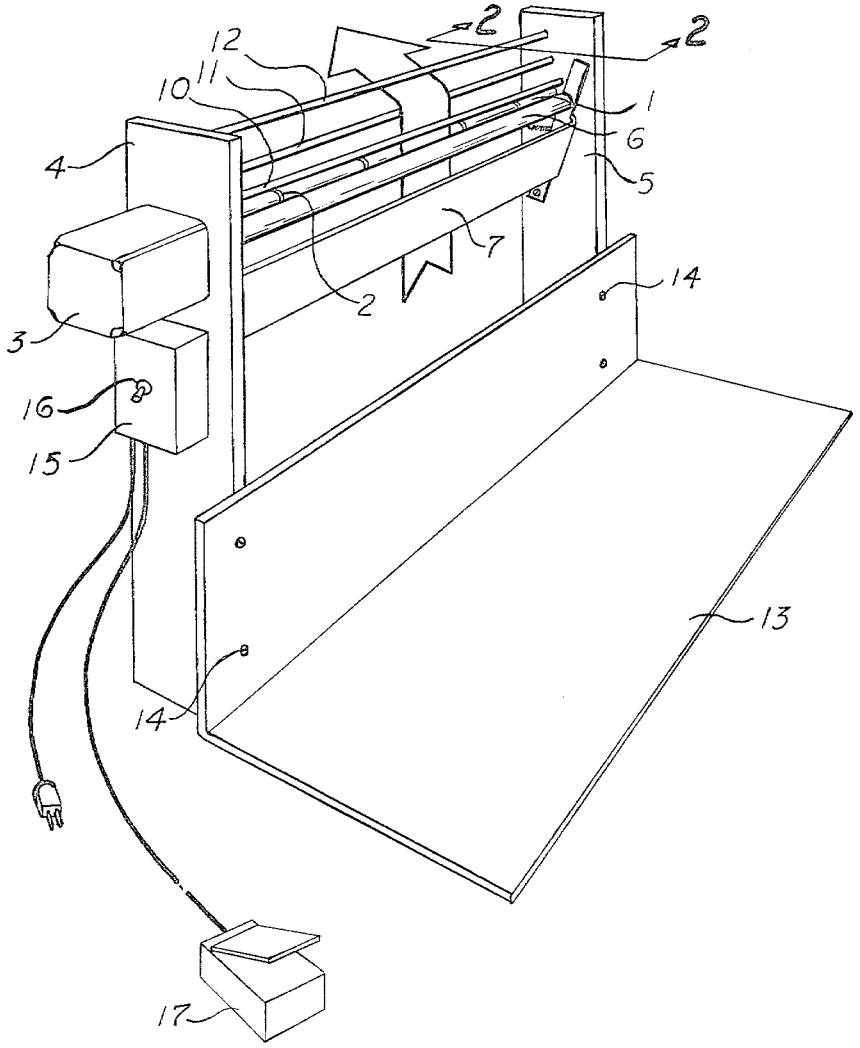
FIG. 1 is a perspective view of one embodiment of the invention.

The feed roller 1 is a half-inch diameter aluminum rod approximately eleven inches long. It has five channels machined into its surface at intervals of about 2½ inches to accommodate rubber friction rings 2. The feed roller 1 is directly attached to the drive shaft of the electric motor 3 through a ¼ inch diameter hole drilled in the left end and is fixed in place by a set screw threaded at a right angle to the shaft. The motor is mounted to the left side vertical support member 4 with the drive shaft passing through a clearance hole to connect to the feed roller 1. The feed roller 1 is mounted on the opposite end in the right side vertical support member 5 and rotates in a Teflon bearing. The electric motor 3 is a 10 rpm synchronous reversible 115 VAC 60 Hz motor with a torque of 180 ounce-inches.

Figure 2:
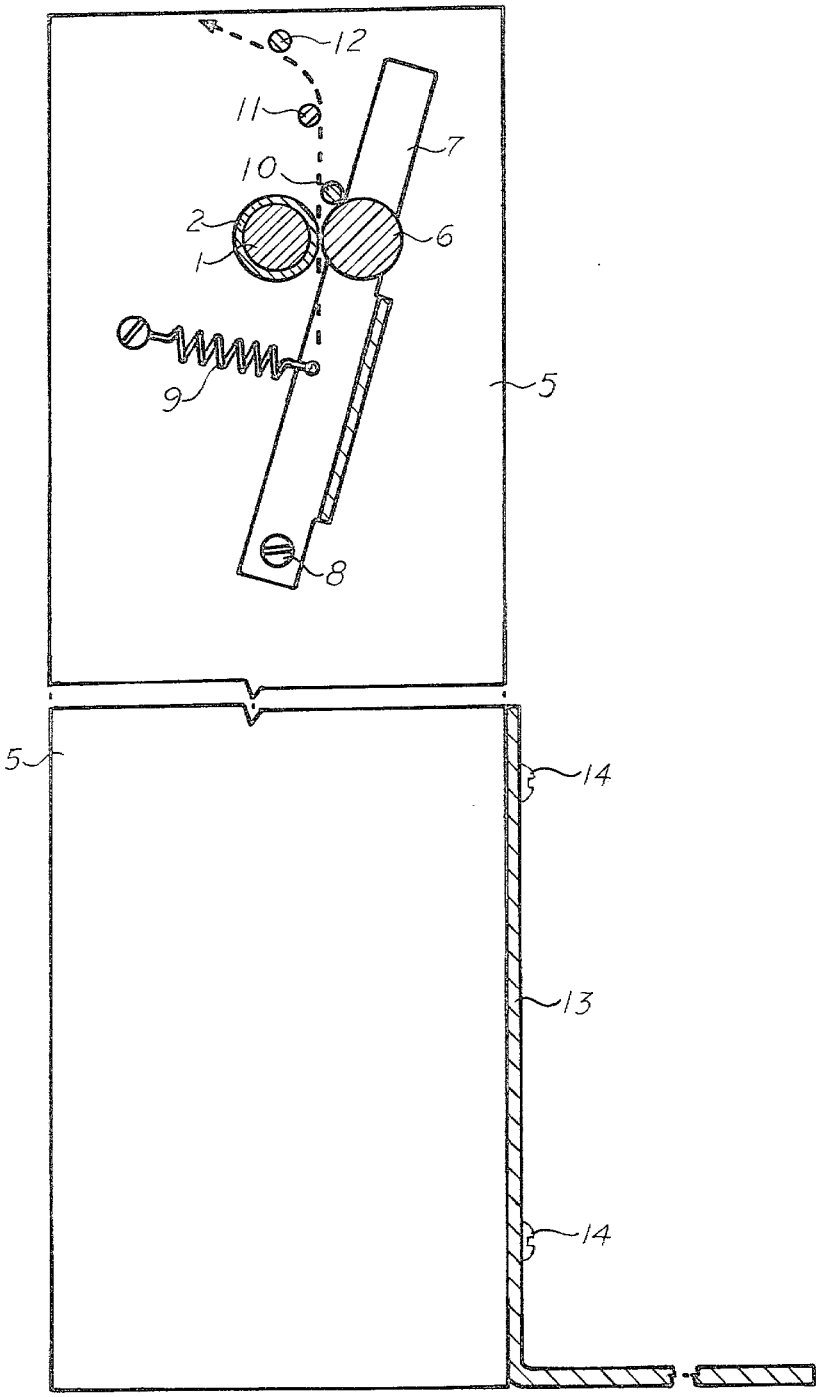
FIG. 2 is a cross sectional view through the rollers 1 and 6 and guide bars 10, 11 and 12 showing the right side vertical support member 5 and the support frame 7 for the tension roller 6.

The tension roller 6 is also a half inch diameter aluminum rod approximately eleven inches long. It is mounted in the top of the support frame 7 be screws from each end which turn in Teflon bushings to allow free rotation against the feed roller 1. The support frame 7 is attached at the bottom to the vertical support members 4 and 5 by screws in Teflon bushings, one of which is illustrated at location 8 in FIG. 2. Tension is applied to the support frame 7 be attachment of springs at each end, one of which is shown at location 9 in FIG. 2.

The guide bars are one-eighth inch diameter steel rods mounted in holes counterbored in the vertical support members 4 and 5. The index bar 10 is located slightly above the feed roller 1 and slightly forward of the paper feed line (dotted line trace in FIG. 2). The vertical keeper bar 11 is located about a half inch above the index bar 10 and slightly behind the paper feed line. The deflector bar 12 is located about half inch above the vertical keeper bar 11 and directly above the feed roll 1.

The vertical support members 4 and 5 are one-quarter inch thick aluminum plates, three inches wide and fourteen inches high; they are stabilized by attachment to a one-eighth inch thick aluminum L-shaped bracket 13 with two screws 14 in each vertical support member.

The electric motor 3 is wired through a capacitor housed in the control box 15 for reversing direction with the switch 16. The motor 3 is actuated by depressing the foot switch 17 which is in series with the reversing switch 16 and the motor 3.

I claim as my invention:

1. A transcription-copy feeder comprising two vertical support members attached to a horizontal L-shaped bracket, a powered feed roller rotatably mounted between said vertical support members, a reversibly rotatable electric motor for continuously driving said feed roller, a remote portable contact switch for activating said electric motor, a capacitor mediated remote two-position switch for electrically reversing the rotation of said electric motor, a free-rolling tension roller rotatably mounted on a support frame, said support frame pivotally attached to said vertical members, said support frame spring-loaded to said vertical support members to establish manually-releasable pressure contact to said feed roller, said feed roller provided with rubber friction rings to present a non-slip surface, said feed roller being operable when driven by said electric motor to translate transcription-copy paper between the contact junction made with said tension roller, a stationary index bar mounted between said vertical support members, said index bar located above said tension roller and forward of feed line of said transcription-copy paper at said contact junction to provide a stationary line index, a vertical keeper bar mounted between said vertical support members, said vertical keeper bar located above said index marker and behind said transcription-copy paper feedline to maintain said transcription-copy paper in a vertical position, a deflector bar mounted between said vertical support members, said deflector bar located above said feed roller and behind said vertical keeper bar to deflect said transcription-copy paper toward the rear of said transcription-copy feeder.

2. A transcription-copy feeder as defined in claim 1 in which said remote portable contact switch for activating said electric motor comprises a foot-operable electrical contact switch.

3. A transcription-copy feeder as defined in claim 1 in which the said remote portable contact switch for activating said electric motor and the said capacitor mediated remote switch for reversing said electric motor are incorporated in a dual function foot-operable switch.

4. A transcription-copy feeder as defined in claim 1 in which the speed of the said electric motor is electrically variable over the range of 10 to 60 revolutions per minute.

* * * * *